US008783486B1

(12) United States Patent
Hoyt et al.

(10) Patent No.: US 8,783,486 B1
(45) Date of Patent: Jul. 22, 2014

(54) BOTTLE STOPPER FOR EVACUATION PUMP

(71) Applicants: Chase H. Hoyt, Los Angeles, CA (US); Robert Q. Hoyt, Los Angeles, CA (US)

(72) Inventors: Chase H. Hoyt, Los Angeles, CA (US); Robert Q. Hoyt, Los Angeles, CA (US)

( * ) Notice: Subject to any disclaimer, the term of this patent is extended or adjusted under 35 U.S.C. 154(b) by 0 days.

(21) Appl. No.: 13/789,717

(22) Filed: Mar. 8, 2013

Related U.S. Application Data

(60) Provisional application No. 61/608,775, filed on Mar. 9, 2012.

(51) Int. Cl.
*B65D 39/14* (2006.01)
*B65D 39/04* (2006.01)
*B65D 51/16* (2006.01)

(52) U.S. Cl.
CPC ..... *B65D 39/14* (2013.01); *B65D 39/04* (2013.01); *B65D 51/1683* (2013.01); *B65D 51/1672* (2013.01)
USPC ..... 215/364; 215/363; 215/355

(58) Field of Classification Search
CPC ..... B65D 51/1683; B65D 51/1672; B65D 51/1644; B65D 39/02; B65D 39/14; B65D 39/04; B65D 39/0023; B65D 39/0005
USPC ..... 215/260, 262, 363, 364, 355, 228; 220/377, 203.04, 203.27, 203.23, 220/203.19, 254.9, 789; 81/3.2
See application file for complete search history.

(56) References Cited

U.S. PATENT DOCUMENTS

| | | | | | |
|---|---|---|---|---|---|
| 2,526,225 | A | * | 10/1950 | Samuel et al. | 215/354 |
| 2,663,451 | A | * | 12/1953 | Yarnall | 220/805 |
| 5,429,256 | A | * | 7/1995 | Kestenbaum | 215/247 |
| D639,657 | S | * | 6/2011 | Hoyt et al. | D9/439 |
| 2010/0327010 | A1 | * | 12/2010 | Manera et al. | 222/1 |

FOREIGN PATENT DOCUMENTS

| | | | | | |
|---|---|---|---|---|---|
| DE | 812036 | C | * | 8/1951 | B65D 39/0023 |
| FR | 515653 | A | * | 4/1921 | B65D 39/02 |
| FR | 1073737 | A | * | 9/1954 | B65D 39/0023 |
| FR | 1074965 | A | * | 10/1954 | B65D 39/0023 |
| FR | 1082517 | A | * | 12/1954 | B65D 39/0023 |
| FR | 70014 | E | * | 2/1959 | B65D 39/0023 |

* cited by examiner

*Primary Examiner* — Robert J Hicks
(74) *Attorney, Agent, or Firm* — Antonio R. Durando

(57) ABSTRACT

A stopper includes a hollow casing with a resilient, ribbed sleeve that forms a valve seat. An interior plunger has a tip configured to mesh with the valve seat when in its down position and to open the valve when in its up position. An upper flange in the plunger provides an additional seal and is visible through a transparent wall in the casing. A vacuum in the bottle draws the plunger downward increasing the pressure with which the plunger presses against the seat, thus securing a long-lasting seal that maintains the vacuum in the bottle. When the vacuum is released, the resilience of the seat structure pushes the plunger upward, rendering it visible as an indicator of vacuum through the transparent wall. An opening in the casing allows connection to a pump to create the vacuum in the bottle.

6 Claims, 3 Drawing Sheets

BOTTLE STOPPER FOR EVACUATION PUMP

RELATED APPLICATIONS

This application is based on and claims the priority of provisional application Ser. No. 61/608,775 filed Mar. 9, 2012, hereby incorporated by reference.

BACKGROUND OF THE INVENTION

1. Field of the Invention

The invention relates to bottle stoppers for maintaining vacuum in a bottle, especially a wine bottle, after de-corking and partial evacuation of air from the bottle.

2. Description of the Prior Art

Wine bottles are normally sealed with corks or caps that are removed to gain access to the wine and then put back on the bottle if the wine is not completely consumed. In order to preserve the freshness of left-over wine that is retained for future consumption, it has become accepted practice to create a vacuum after the cork is put back on the bottle. This condition is believed to prolong the shelf life of an open bottle of wine by minimizing the effect of oxygen on the wine left over in the bottle.

To that end, various pumps and related stoppers have been developed that make it possible to create and retain a certain degree of vacuum in the bottle. Such stoppers have a check valve that allows air to flow out of the bottle but not into the bottle. The pumps are used to extract the air from the bottle with the stopper in place. Some pumps are hand operated while others are battery driven, but typically air is evacuated from the bottle by the stroke of a piston. The resulting vacuum in the bottle inhibits oxidation of the remaining wine contents so that freshness and flavor are preserved for some period of time.

The main problem with the stoppers heretofore found in the art is the fact that they lose vacuum rapidly and predictably. Thus, the preservation effect is gradually reduced to the point of no utility in spite of the careful placement of the stopper in the bottle and the relatively high initial level of vacuum generated by the pump. In essence, these devices have proven to be more a matter of style than substance. This invention is directed at providing an improved stopper that retains a constant level of vacuum for at least ten days, after which it is assumed that a wine enthusiast would not drink left-over wine anyway.

SUMMARY OF THE INVENTION

One aspect of the invention resides in a stopper with a check valve configured to provide a seal commensurate with the level of vacuum applied to it. The valve is made up of a resilient seat structure (such as made of silicone or rubber) and a plastic plunger with a conical tip designed to mesh perfectly with a seal opening in the seat. The seat structure is dome shaped with the seat opening at the top of the dome and is located at the bottom of the stopper facing up, toward the outside of the bottle. The plunger is slidably contained in a casing above the seat structure so as to engage the seat opening to seal the bottle when the plunger is in its down position and to open the valve when in its up position. As a result of this configuration, a vacuum in the bottle tends to draw the plunger downward pressing on the resilient seat, thereby causing it to push progressively harder against the silicone seat with increased vacuum and form a secure seal between the tip of the plunger and the opening in the seat. Because the seat structure is dome shaped and facing upward, the vacuum in the bottle, which tends to pull the seat downward, will not cause it to deform and break the seal as would happen if the seat where on a planar structure. Rather, it increases the pressure with which the plunger presses against the seat, thus securing a long-lasting seal that maintains the vacuum in the bottle.

According to another aspect, the top of the plunger features a flange that is housed in a larger, cylindrical, top section of the stopper casing. The flange is configured to sit on the bottom of this cylindrical structure when in its down position so as to provide an additional seal that prevents passage of air to the interior of the bottle. When the vacuum in the bottom is released, the resilience of the silicone seat structure provides an upward displacement of the plunger that produces a separation between the flange and the casing to allow air flow around the flange and through the casing in the space between the plunger and the casing wall.

The top surface of the casing has an opening for connection to a pump to extract air and create a vacuum in the bottle. When that is done, the vacuum provided by the pump sucks the plunger upward all the way to the top of the larger cylindrical section of the casing, causing the plunger tip to release the seat so that air can be drawn out of the bottle. According to another aspect of the invention, three protrusions in the top surface of the plunger prevent it from butting against the interior top surface of the casing and form a seal that would hinder air evacuation from the bottle. As the application of vacuum from the pump ceases, the tip of the plunger, by its own weight and drawn by the vacuum in the bottle, moves downward and engages the valve seat to form a seal. The vacuum in the bottle then also sucks in the seat structure drawing it downward until the flange in the plunger engages the interior bottom surface in the larger section of the casing, which provides an additional seal to secure maintenance of the vacuum in the bottle.

According to yet another aspect of the invention, the vertical wall of the larger section of the casing containing the plunger's flange is transparent to display the vertical position of the plunger as an indication of the degree of vacuum present in the bottle. When the vacuum is at its intended level, the seat of the valve structure is pulled down to its lowest possible position, causing the flange of the plunger to but against the interior bottom surface of the larger section of the casing. In that low position the flange is barely visible though the transparent wall. As vacuum is lost, the resilience of the silicone valve tends to gradually push the plunger upward, which correspondingly elevates the flange in the casing and renders it more visible through the transparent wall. When the pressure in the bottle is substantially equal to atmosphere, the tip of the plunger simply rests on the opening of the valve seat without forming an effective seal. Correspondingly, the flange is at its highest position and is visible in its entirety. To that end, it is preferable for the flange to have a different color that provides contrast with the rest of the stopper.

Additional features and advantages of the invention will be forthcoming from the following detailed description of certain specific embodiments when read in conjunction with the accompanying drawings.

DESCRIPTION OF THE PREFERRED EMBODIMENTS

Figure 1:
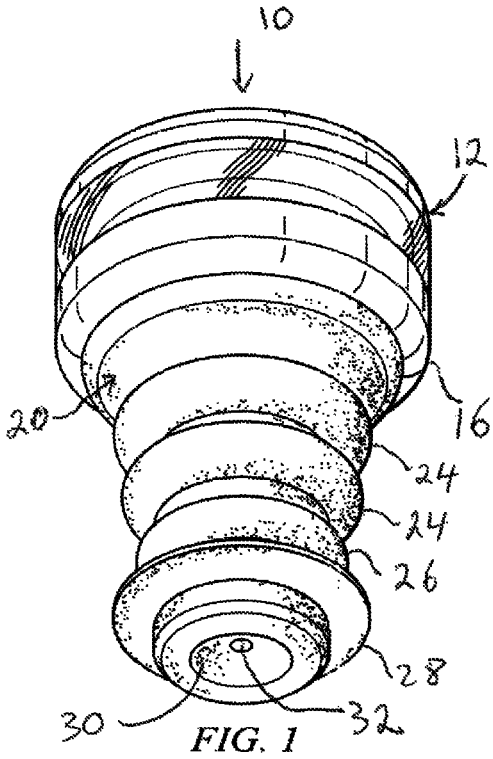
FIG. 1 is a perspective bottom view of a stopper according to the invention.
Figure 5:
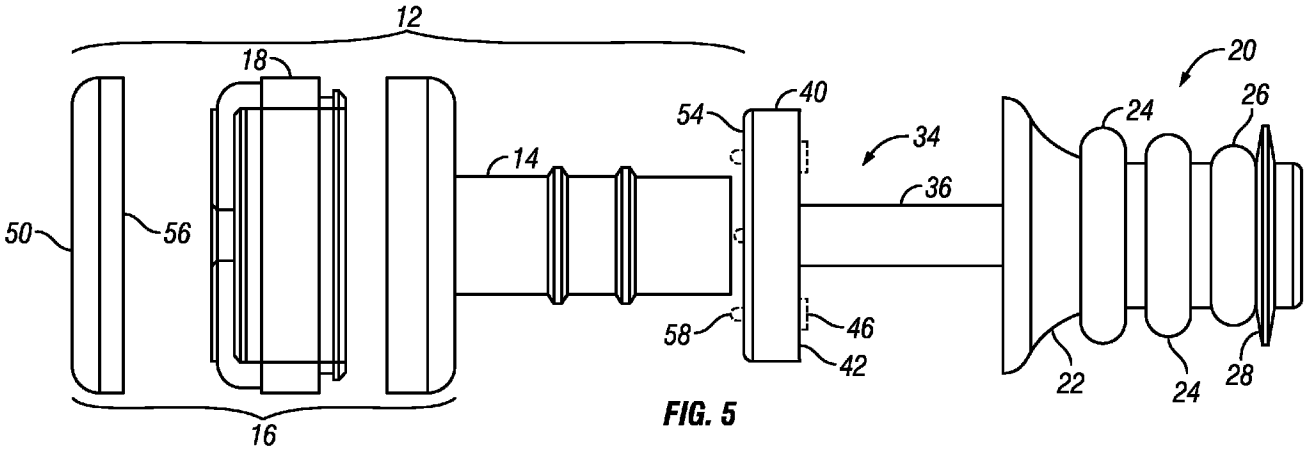
FIG. 5 is an exploded view showing the various components of the stopper of the invention (noting that the components are not aligned as they would be seen upon explosion).
Figure 6:
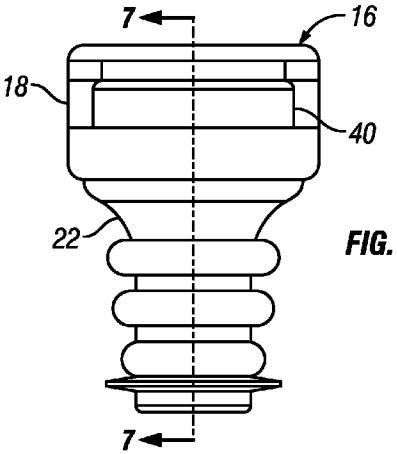
FIG. 6 is an elevational view of the stopper of the invention, as shown in FIG. 1.

Referring to FIG. 1, a stopper 10 according to the invention is illustrated in bottom perspective view. As also seen in the top perspective view of FIG. 2 and the exploded view of FIG. 5, the stopper 10 is the combination of several separate components. A hollow casing 12 provides the structure around which the stopper is formed and consists of a lower tubular section 14 (seen in the exploded view of FIG. 5) and an upper, larger, cylindrical section 16. The casing is preferably made of plastic and the outer wall 18 of the cylindrical portion 16 is preferably transparent. A silicone sleeve 20 is mounted on the lower tubular section 14 and provides the structure that seals the stopper to the inner wall of the neck of the bottle being evacuated for preservation of its contents. To that end, the sleeve 20 has a main core structure 22 (see also FIG. 6) of generally frusto-conical geometry for insertion into the neck of the bottle and several ribs that provide the seal. As seen in the various figures, three ribs are preferred with two upper ribs 24 of substantially equal diameter and a lower rib 26 with a smaller diameter for ease of insertion into the neck of the bottle. A larger-diameter disk 28 is preferably also provided at the tip of the stopper to clean the neck of the bottle, by sweeping down residual cork particles and other debris that may be present, as the stopper 10 is pushed down into the bottle. As an additional benefit, the disk 28 may contribute to overall effect of the stopper by forming an initial seal between the interior of the bottle and the surrounding environment.

Figure 4:
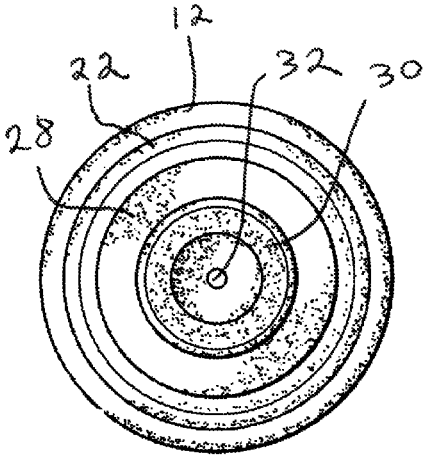
FIG. 4 is a bottom view of the stopper of FIG. 1.
Figure 7:
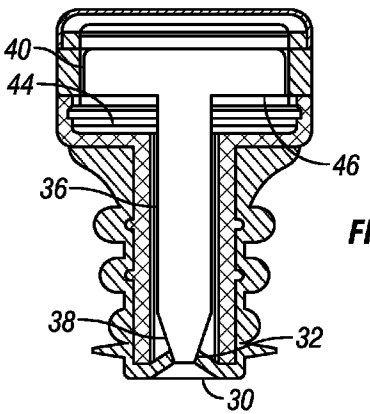
FIG. 7 is a cross-sectional view of the stopper of FIG. 6 taken along line A-A in that figure.

Formed into the bottom of the sleeve 20 is a valve seat 30 that enables the evacuation of air from the bottle and the subsequent retention of vacuum, the main objective of the invention. The valve seat 30, also shown in FIG. 4, consists of a dome-shaped structure facing upward toward the interior of the lower tubular section 14 of the casing 12. An aperture 32 at the top of the seat 30 provides the opening through which air is evacuated from the bottle. As seen better in the cross-section of FIG. 7, the aperture 32 has a depth and a corresponding wall defined by the thickness of the silicone sleeve at the bottom of the stopper. As will be detailed below, the wall of the aperture is shaped so as to optimize its engagement with a plunger to form the seal provided by the valve structure.

The stopper 10 further includes a plunger 34 with a lower shaft 36 configured to be slidably housed in the lower tubular section 14 of the casing 12. The tip 38 of the shaft is conical in shape with a wall tapered to the degree necessary to conform to the wall of the aperture 32 in the valve seat 30 when no vacuum is exerted on the valve. This ensure maximum contact between the surfaces of the aperture 32 and the tip 38 to provide an optimum seal. The diameter of the shaft 36 of the plunger is slightly smaller than the inner diameter of the tubular section 14 of the casing to allow flow of air between the two. The top portion of the plunger is an enlarged flange 40 sized to be similarly housed in the top section 16 of the casing 12. The outer wall of the flange 40 is preferably colored so as to be clearly visible through the transparent wall 18 of the casing. The length of the shaft 36 of the plunger is selected so that the flange 40 is high in the casing and preferably completely visible through the wall 18 when the tip 38 of the shaft is resting on the seat 30 of the valve under atmospheric conditions (that is, when not subjected to a vacuum pull from inside the bottle). The length of the shaft 36 is also selected such that the bottom 42 of the flange 40 buts against the interior lower surface 44 of the cylindrical section 16 of the casing (shown in FIG. 7) when the seat 30 of the valve is drawn down to the maximum degree by the vacuum in the bottle, thereby providing an additional seal between the plunger and the casing. Though not necessary for a degree of vacuum retention suitable for wine preservation of a couple of weeks, an O-ring 46 may be provided to increase the effectiveness of this seal. Finally, the thickness of the flange 40 is preferably selected such that it is substantially all below the wall 18 and not visible when the valve is under maximum vacuum conditions.

Figure 2:
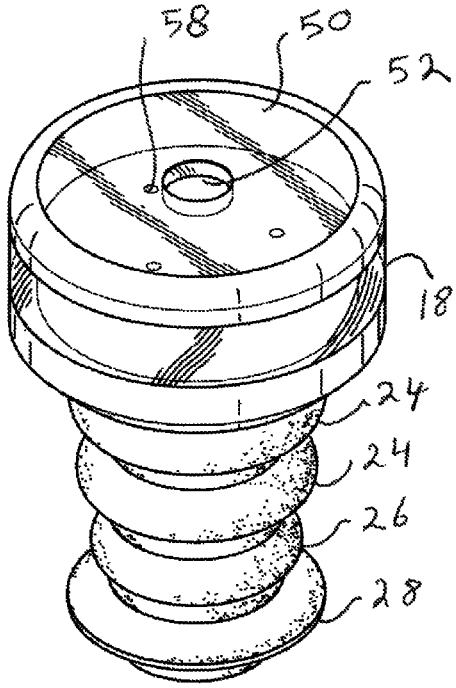
FIG. 2 is a perspective top view of the same stopper.
Figure 3:
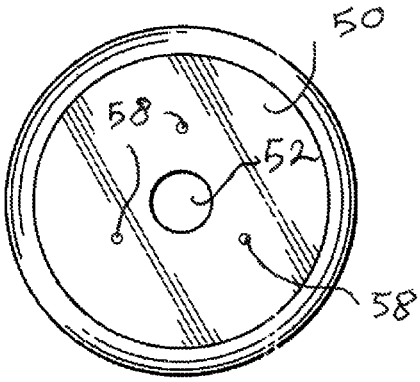
FIG. 3 is a top view of the stopper of FIG. 1.

The top surface 50 of the upper section 16 of the casing, shown as transparent in FIGS. 2 and 3, contains an opening 52 for coupling the stopper to an evacuating pump (not shown) used to produce the vacuum in the bottle. Any conventional connection suitable for providing sufficient seal is acceptable. For example, a rubberized nozzle adapted for snap-on connection with the opening 52 is anticipated for the pump used with the stopper 10. In operation, the stopper 10 is inserted into the neck of the bottle causing the three ribs 26,24,24 to form a triple seal to prevent air passage between the stopper and the glass. As mentioned, the disk 28 sweeps the interior of the bottle neck clean as stopper is being pushed inward, thus improving the effectiveness of the seal. The stopper is then connected to a pump that produces the vacuum to be projected to the interior of the bottle through the opening 52, through the space between the plunger and the casing, and through the check valve aperture 32. Subjected to aspiration by the pump, the plunger 34 is lifted upward all the way to the point where its tip 38 clears the aperture 32 of the check valve and the top 54 of the flange 40 meets the interior surface 56 of the upper section 16 of the casing. Because such contact would tend to restrict air flow to the opening 52, a number of protrusions 58 (three are shown) is preferably formed in the top surface of the flange in order to leave sufficient space for good flow when the plunger is in this upmost position.

Figure 8C:
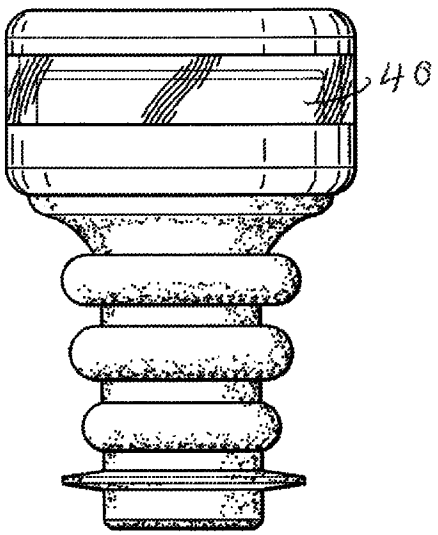
FIG. 8C is an elevational view of the stopper of the invention illustrating a no-vacuum condition.
Figure 8B:
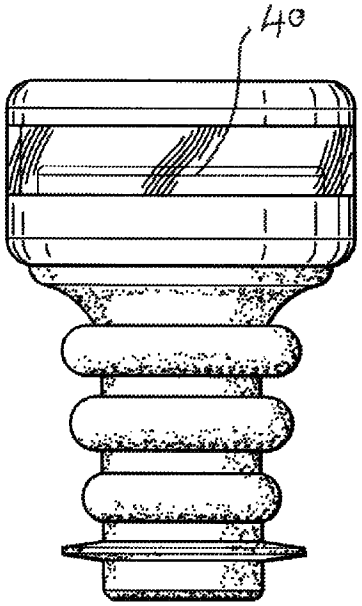
FIG. 8B is an elevational view of the stopper of the invention illustrating an intermediate vacuum condition.
Figure 8A:
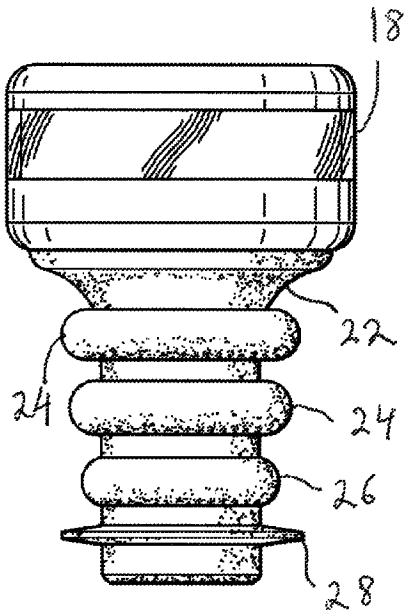
FIG. 8A is an elevational view of the stopper of the invention illustrating a maximum vacuum condition.

When the desired degree of vacuum is established in the bottle and the evacuating pump is turned off, the suction provided by the vacuum in the interior of the bottle pulls the valve seat 30 and the plunger 36 all the way down forming a seal both between the aperture 32 and the tip 38 of the plunger at the bottom of the stopper and between the flange and the casing at the top of the stopper. Under those conditions, the flange 40 of the plunger is not visible through the transparent wall 18 of the casing, as illustrated in FIG. 8A. The resilience of the material used to make the valve seat 30 and its dome-shape geometry are selected to produce this condition when the vacuum in the bottle reaches about 8 inches of mercury, which is believed to guarantee little or no deterioration for a period if at least ten days. As time passes and vacuum is gradually lost, the resilience of the valve seat will push the plunger commensurately upward and the flange 40 will begin to appear through the wall 18, as illustrated in FIG. 8B. When atmospheric balance is again present in the bottle (i.e., the vacuum is completely lost), the flange of the plunger will be completely visible, as shown in FIG. 8C, and the user will be alerted to that fact.

Tests have shown that the stopper of the invention maintains a vacuum of 8" Hg (i.e., a negative relative pressure of that magnitude) for 10 days without any appreciable leakage. After 10 days the test was stopped because considered useless in view of the unavoidable natural degradation of wine regardless of the vacuum applied to it. It is believed that the tannins in the wine begin to oxidize and produce hydrogen peroxide that combines with ethanol to form acetaldehyde, the compound that produces the odor that destroys wine's freshness and fragrance. All prior-art stoppers tested under the same conditions showed a marked and progressive reduction in vacuum beginning the very same day the bottle was evacuated and sealed.

Various modifications are possible within the meaning and range of equivalence of the appended claims.

The invention claimed is:

1. A stopper for evacuating and maintaining a vacuum, comprising:

a hollow casing having a lower tubular section and an upper cylindrical section with a transparent wall;

a resilient sleeve mounted on said lower section of the casing and forming a valve seat thereon, said seat having a dome-shaped geometry pointing upward with an aperture facing the lower section of the casing;

a plunger slidably inserted in the casing, said plunger including a lower shaft with a tip adapted to mesh with the aperture in the valve seat to form a seal and an upper flange housed in said upper cylindrical section of the casing; and an opening in said upper cylindrical section of the casing for connection with an evacuating pump;

wherein the sleeve includes exterior resilient ribs for sealed retention of the stopper in a bottle, said ribs having respective diameters; and wherein the plunger is movable between an upper position, where the tip is removed from the valve seat and the flange is visible through said transparent wall, and a lower position, where the tip is connected to the valve seat to form a seal and the valve seat is resiliently drawn downward toward the bottle and where said upper flange buts against the casing to form an additional seal.

2. The stopper of claim 1, further comprising an O-ring in said flange to form said additional seal.

3. The stopper of claim 1, further comprising protrusions in said flange to separate a top surface of the flange from an interior surface of the casing.

4. The stopper of claim 1, wherein said ribs are three ribs spaced apart along said sleeve, said three ribs comprising a top rib and an intermediate rib with a predetermined diameter and a bottom rib with a smaller diameter than said predetermined diameter.

5. The stopper of claim 1, further comprising a resilient disk attached to a bottom portion of the sleeve, said disk having a diameter larger than said diameters of the ribs.

6. The stopper of claim 1, wherein said sleeve is made of silicone.

* * * * *